US006683423B2

(12) United States Patent
Cunningham

(10) Patent No.: US 6,683,423 B2
(45) Date of Patent: Jan. 27, 2004

(54) LIGHTING APPARATUS FOR PRODUCING A BEAM OF LIGHT HAVING A CONTROLLED LUMINOUS FLUX SPECTRUM

(76) Inventor: David W. Cunningham, 8442 Hollywood Blvd., Los Angeles, CA (US) 90069

( * ) Notice: Subject to any disclaimer, the term of this patent is extended or adjusted under 35 U.S.C. 154(b) by 0 days.

(21) Appl. No.: 10/118,828

(22) Filed: Apr. 8, 2002

(65) Prior Publication Data

US 2003/0189412 A1 Oct. 9, 2003

(51) Int. Cl.[7] ..... H05B 37/00
(52) U.S. Cl. ..... 315/312; 362/231
(58) Field of Search ..... 315/291, 312, 315/313, 317, 318, 319; 362/230, 231

(56) References Cited

U.S. PATENT DOCUMENTS

| | | | | |
|---|---|---|---|---|
| 5,684,309 | A | 11/1997 | McIntosh et al. | 257/191 |
| 5,803,579 | A | 9/1998 | Turnbull et al. | 362/83.1 |
| 5,961,201 | A * | 10/1999 | Gismondi | 362/233 |
| 6,016,038 | A | 1/2000 | Mueller et al. | 315/291 |
| 6,150,774 | A | 11/2000 | Mueller et al. | 315/291 |
| 6,166,496 | A | 12/2000 | Lys et al. | 315/316 |
| 6,211,626 | B1 | 4/2001 | Lys et al. | 314/291 |
| 6,292,901 | B1 | 9/2001 | Lys et al. | 713/300 |
| 6,329,764 | B1 | 12/2001 | van de Ven | 315/291 |
| 6,330,111 | B1 | 12/2001 | Myers | 359/599 |
| 6,340,868 | B1 | 1/2002 | Lys et al. | 315/185 S |
| 2002/0074559 | A1 | 6/2002 | Dowling et al. | 257/99 |
| 2002/0176259 | A1 | 11/2002 | Ducharme | 362/545 |
| 2003/0107887 | A1 | 6/2003 | Eberl | 362/227 |

FOREIGN PATENT DOCUMENTS

| | | |
|---|---|---|
| WO | WO 99/30537 A1 | 6/1999 |
| WO | WO 99/31560 | 6/1999 |
| WO | WO 01/36864 A2 | 5/2001 |
| WO | WO 01/73818 A1 | 10/2001 |
| WO | WO 02/01921 A1 | 1/2002 |
| WO | WO 03/024269 A1 | 3/2003 |

* cited by examiner

*Primary Examiner*—David Vu
(74) *Attorney, Agent, or Firm*—Sheppard, Mullin, Richter & Hampton LLP; James R. Brueggemann

(57) ABSTRACT

An improved lighting apparatus, suitable for use as part of a lighting fixture, is disclosed, having a plurality of groups of distinct light-emitting devices, e.g., light-emitting diodes, that can be controlled to produce a beam of light having a wide variety of complex luminous flux spectra, including, but not limited, to spectra that closely emulate that of any one of a number of conventional light sources, with or without a conventional chemical dye filter. Each group of light-emitting devices is configured to emit light having a distinct luminous flux spectrum. A controller supplies selected amounts of electrical power to two or more groups of the plurality of groups of light-emitting devices, such that the groups cooperate to produce a composite beam of light having a selected luminous flux spectrum. The spectrum can be controlled to have a normalized mean deviation across the visible spectrum, relative to that of a beam of light to be emulated, of less than about 30%. This a marked improvement over all known lighting fixtures of the kind including multiple groups of distinct light sources. The groups of light-emitting devices are configured to include independently selected quantities of devices. Further, the groups of light-emitting devices are configured to each have a spectral half-width of less than about 40 nanometers (nm) and to have a peak flux wavelength that is spaced less than about 50 nm from that of an adjacent group.

43 Claims, 5 Drawing Sheets

LIGHTING APPARATUS FOR PRODUCING A BEAM OF LIGHT HAVING A CONTROLLED LUMINOUS FLUX SPECTRUM

BACKGROUND OF THE INVENTION

This invention relates generally to lighting fixtures and, more particularly, to a lighting apparatus suitable for use as part of a lighting fixture, and configured to produce light having a selected color.

Lighting fixtures have been used for many years in theater, television, and architectural lighting applications. Typically, each fixture includes an incandescent lamp mounted adjacent to a concave reflector, which reflects light through a lens assembly to project a beam of light toward a theater stage or the like. A color filter can be mounted at the fixture's forward end, for transmitting only selected wavelengths of the light emitted by the lamp, while absorbing and/or reflecting other wavelengths. This provides the projected beam with a particular spectral composition.

The color filters used in these lighting fixtures typically have the form of glass or plastic films, e.g., of polyester or polycarbonate, carrying a dispersed chemical dye. The dyes transmit certain wavelengths of light, but absorb the other wavelengths. Several hundred different colors can be provided by such filters, and certain of these colors have been widely accepted as standard colors in the industry.

Although generally effective, such plastic color filters usually have limited lifetimes, caused principally by the need to dissipate large amounts of heat derived from the absorbed wavelengths. This has been a particular problem for filters transmitting blue and green wavelengths. Further, although the variety of colors that can be provided is large, these colors nevertheless are limited by the availability of commercial dyes and the compatibility of those dyes with the glass or plastic substrates. In addition, the very mechanism of absorbing non-selected wavelengths is inherently inefficient. Substantial energy is lost to heat.

In some lighting applications, gas discharge lamps have been substituted for the incandescent lamps, and dichroic filters have been substituted for the color filters. Such dichroic filters typically have the form of a glass substrate carrying a multi-layer dichroic coating, which reflects certain wavelengths and transmits the remaining wavelengths. These alternative lighting fixtures generally have improved efficiency, and their dichroic filters are not subject to fading or other degradation caused by overheating. However, the dichroic filters offer only limited control of color, and the fixtures cannot replicate many of the complex colors created by the absorptive filters that have been accepted as industry standards.

It often is desirable to change the color of the light being produced by a particular lighting fixture, so several remotely operated color-changing devices have been developed in recent years. One such device is a color scroller, which includes a scroll typically containing 16 preselected filters. These filters are subject to the same problems of fading and deformation as are the individual filters. Another such device is a dichroic color wheel, which includes a rotatable wheel carrying about eight preselected dichroic coatings. These color wheels avoid the noted problems of fading and deformation, but are able to carry fewer colors and are substantially more expensive than is a color scroller.

Other such remotely operated color-changing devices include a CMY filter scroller system and a CMY dichroic color mixing system, the latter of which can provide about 16 million combinations of separate colors. However, because both CMY systems use filters that each transmit only about one third of the visible spectrum, they are unable to replicate the spectral nuances of a complex color, including those produced by a conventional color filter in combination with a full-spectrum incandescent light source.

Yet other such remotely operated color-changing devices include an incandescent RGB fixture, such as a theatrical strip light. Such fixtures have similar problems to those of the two CMY systems described briefly above. In such fixtures, one-third of the visible spectrum is provided by each of three separately filtered lid sources. Thus, these fixtures waste two-thirds of the light energy just to project white light, and they waste even more light energy when projecting colored light.

Recently, some lighting fixtures have substituted light-emitting diodes (LEDs) for incandescent lamps and gas-discharge lamps. Equal quantities of red-, green-, and blue-colored LEDs typically have been used, arranged in a suitable array. Some LED fixtures have further included an equal quantity of amber-colored LEDs. By providing electrical power in selected amounts to these LEDs, typically using pulse-width modulated electrical current, light having a variety of colors can be projected. These fixtures eliminate the need for color filters, thereby improving on the efficiency of prior fixtures incorporating incandescent lamps or gas-discharge lamps.

Lighting fixtures incorporating red-, green-, and blue-colored LEDs, i.e., RGB LED fixtures, can project beams of light having an apparent color of white, especially when illuminating a white or other fully reflective surface. However, the actual spectrum of this apparent white color is not at all the same as that of the white light provided by fixtures incorporating incandescent lamps. This is because LEDs emit light in narrow wavelength bands, and merely three different LED colors are insufficient to cover the full visible spectrum. Colored objects illuminated by such RGB LED fixtures frequently do not appear in their true colors. For example, an object that reflects only yellow light, and thus that appears to be yellow when illuminated with white light, will appear black when illuminated with light having an apparent yellow color, produced by the red and green LEDs of an RGB LED fixture. Such fixtures, therefore, are considered to provide poor color rendition when illuminating a setting such as a theater stage, television set, building interior, or display window.

A limited number of LED lighting fixtures have included not only LEDs emitting red, green, and blue light, but also LEDs emitting amber light. Such fixtures are sometimes called RGBA LED fixtures. These fixtures are subject to the same drawbacks as are RGB LED fixtures, but to a slightly reduced degree.

FIG. 1 depicts the luminous flux spectrum of a beam of light projected by a prior art Source Four® lighting fixture having an incandescent lamp operating at about 3250° Kelvin (° K) and having no color filter in the beam's path. The Source Four® fixture is available from Electronic Theatre Controls, of Middleton, Wis. It will be noted that the spectrum is generally bell-shaped across the visible spectrum, i.e., from about 420 nanometers (nn) to about680 run. The actual radiometric flux spectrum for the light is fairly uniform; however, the depicted luminous flux spectrum is derived by multiplying the radiometric flux spectrum by the spectral sensitivity of the human eye, which is generally bell-shaped. Humans generally perceive the light to be white and are pleased with its appearance.

Also depicted in FIG. 1 is the luminous flux spectrum of a beam of light produced by a prior art RGB LED lighting fixture having equal quantities of red-, green-, and blue-colored LEDs, operating at full power. The two depicted spectra are normalized so that they have approximately equal total flux.

Against a white background or other fully reflective surface, humans will perceive the light produced by the prior art RGB LED lighting fixture, operating at full power, to be somewhat bluish-white. It will be noted in FIG. 1, however, that the actual luminous flux spectrum of such light is highly non-uniform and differs substantially from that of the light produced by the incandescent lamp fixture. This spectral difference can lead to sharp differences in the appearances of many colored objects illuminated by such light.

Integrating the absolute value of the difference between the two spectra depicted in FIG. 1, i.e., the luminous flux spectrum of light produced by an incandescent lamp lighting fixture and the luminous flux spectrum of light produced by an RGB LED lighting fixture, across the visible spectrum, provides a useful measure of conformance between the two spectra. This conformance measure is referred to as a Normalized Mean Deviation (NMD). An NMD of 0% would represent exact conformance between the two spectra. In the particular case of the two spectra depicted in FIG. 1, an NMD of 57.1% is realized. This is considered to be undesirably high, and it indicates that the RGB LED lighting fixture provides a poor emulation of the incandescent lamp lighting fixture and thus provides poor color rendition.

It should be apparent from the foregoing description that there is a need for an improved lighting apparatus, suitable for use as part of a lighting fixture, having individually colored light sources, e.g., LEDs, that improve on the power efficiency of fixtures incorporating incandescent lamps and gas-discharge lamps, yet that can produce beams of light having luminous flux spectra that can be more precisely controlled and, further, that can closely emulate the spectra of prior lighting fixtures and thus provide improved color rendition. The present invention satisfies these needs and provides further related advantages.

SUMMARY OF THE INVENTION

One feature of the present invention resides in a lighting apparatus, suitable for use as part of a lighting fixture, for producing a beam of light having a precisely controlled luminous flux spectrum including, for example spectra emulating that of a beam of light produced by a predetermined light source, with or without a color filter. The lighting apparatus includes a plurality of groups of light-emitting devices, each such group configured to emit light having a distinct luminous flux spectrum, with a peak flux wavelength and a predetermined spectral half-width. The spectral half-width of each group is less than about 40 nanometers (nm), and the groups are configured such that the peak flux wavelength of each group is spaced less than about 50 nm from that of another group. The lighting apparatus further includes a controller configurable to supply selected amounts of electrical power to the groups of light-emitting devices, such that the groups cooperate to produce a composite beam of light having a prescribed luminous flux spectrum.

Another feature of the invention resides in a lighting apparatus, suitable for use a part of a lighting fixture, for producing a beam of light having a luminous flux spectrum emulating that of a beam of light produced by a predetermined light source having an incandescent lamp, such light source being free of a filter that modifies the luminous flux spectrum of the light emitted by the lamp. The lighting apparatus includes a plurality of groups of light-emitting devices and further includes a controller configurable to supply selected amounts of electrical power to the groups of light-emitting devices. The groups cooperate to produce a composite beam of light having a prescribed luminous flux spectrum that has a normalized mean deviation across the visible spectrum of less than about 30% relative to the luminous flux spectrum of a beam of light produced by the predetermined light source to be emulated.

More preferably, the luminous flux spectrum of the composite beam of light has a normalized mean deviation across the visible spectrum of less than 25%, and most preferably less than 20%, relative to that of the beam of light to be emulated. In addition, in this feature of the invention, the quantities of devices included in each of the plurality of groups of light-emitting devices can be selected such that, if the controller supplies maximum electrical power to all of the groups, then the resulting composite beam of light will have a luminous flux spectrum having a normalized mean deviation across the visible spectrum of less than about 30% relative to the luminous flux spectrum of a beam of light to be emulated. In addition, the luminous flux spectra of the beam of light produced by the lighting apparatus and of the beam of light produced by the predetermined light source to be emulated preferably are within 5 db of each other across the visible spectrum when the controller supplies prescribed maximum amounts of electrical power to all of the groups of light-emitting devices.

Alternatively, the quantities of devices included in each of the plurality of groups of light-emitting devices are selected such that, if the controller supplies maximum electrical power to all of the groups, then the resulting composite beam of light will have a luminous flux spectrum emulating that of any other prescribed light source. For example, the spectrum of the composite beam of light could be made to have a normalized mean deviation across the visible spectrum of less than about 30% relative to the luminous flux spectrum of a theoretical beam of light produced by a predetermined light source having an incandescent lamp, but modified by a theoretical superposition of the spectral transmissions of a plurality of known color filters.

Another independent feature of the invention resides in a lighting apparatus for producing a beam of colored light having a prescribed luminous flux spectrum, the apparatus including a plurality of groups of light-emitting devices, and further including a controller configurable to supply selected amounts of electrical power to the groups of light-emitting devices, such that they cooperate to produce a composite beam of light having a luminous flux spectrum with substantial energy only within a contiguous bandwidth of less than about 200 nm when the controller supplies prescribed maximum amounts of electrical power to all of the groups of light-emitting devices. More preferably, the flux spectrum has substantial energy only within a contiguous bandwidth of less than about 150 nm. In addition, no portion of the contiguous flux spectrum has an intensity more than 5 db lower, or more preferably 2 db lower, than intensities at wavelengths both above and below it.

More particularly, in this feature of the invention, the controller is configurable to supply selected amounts of electrical power to the groups of light-emitting devices, such that the composite beam of light has a luminous flux spectrum emulating that of a predetermined light source having an incandescent lamp and an associated filter that modifies the luminous flux spectrum of the light emitted by the lamp. The luminous flux spectrum of the composite beam of light has a normalized mean deviation across the visible spectrum of less than about 30% relative to the luminous flux spectrum of a beam of light to be emulated. In one example, the quantities of devices included in each of the groups of light-emitting devices are selected such that, if the controller supplies maximum electrical power to all of the groups, then the resulting composite beam of light will have a luminous flux spectrum having a normalized mean deviation across the visible spectrum of less than about 30% relative to the luminous flux spectrum of a theoretical beam of light produced by the predetermined light source, as modified by a theoretical superposition of the spectral transmissions of a plurality of known color filters.

Further, in this feature of the invention, the groups of light-emitting devices can be configured such that the composite beam of light has a luminous flux spectrum having substantial energy only in wavelengths of less than about 600 nm when the controller supplies prescribed maximum amounts of electrical power to all of the groups of light-emitting devices. Alternatively, the groups of light-emitting devices can be configured such that the composite beam of light has a luminous flux spectrum having substantial energy only in wavelengths of more than about 550 um when the controller supplies prescribed maximum amounts of electrical power to all of the groups of light-emitting devices.

Yet another independent feature of the invention resides in a lighting apparatus for producing a beam of light having a prescribed luminous flux spectrum, wherein at least two of a plurality of groups of light-emitting devices include different quantities of devices. The lighting apparatus further includes a controller configurable to supply selected amounts of electrical power to the groups of light-emitting devices, such that they cooperate to produce a composite beam of light having a prescribed luminous flux spectrum. The specific quantities of devices in each group can be selected to provide certain advantages when the lighting apparatus is used to emulate the luminous flux spectrum provided by a particular light source. For example, the quantities can be selected such that if the controller supplies maximum electrical power to all of the groups, then the resulting composite beam of light will have a luminous flux spectrum closely matching that of the beam of light to be emulated.

Still another independent feature of the invention resides in a lighting apparatus that includes five or more groups of light-emitting devices, and further includes a controller configurable to supply selected amounts of electrical power to the five or more groups of light-emitting devices, such that the groups cooperate to produce a composite beam of light having a prescribed luminous flux spectrum. Preferably the lighting apparatus includes eight or more such groups of light-emitting devices, to facilitate greater control of the luminous flux spectrum of the composite beam of light.

In more detailed features of the invention, the groups of light-emitting devices each include a plurality of light-emitting diodes. In addition, the groups of light-emits devices together can comprise an optical assembly that collects the emitted light and projects the composite beam of the light from the lighting apparatus.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

Embodiments of the present invention will now be described, by way of example only, with reference to the following drawings, in which.

DESCRIPTION OF THE PREFERRED EMBODIMENTS

Figure 4:
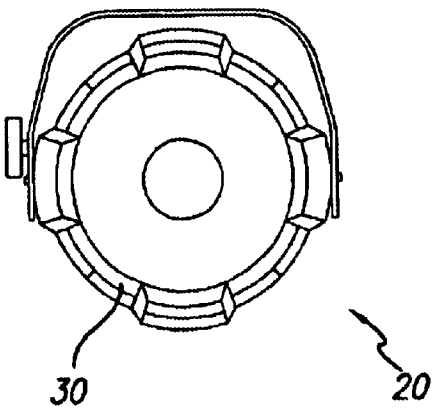
FIG. 4 is a rear elevational view of the lighting fixture of FIG. 2.
Figure 3:
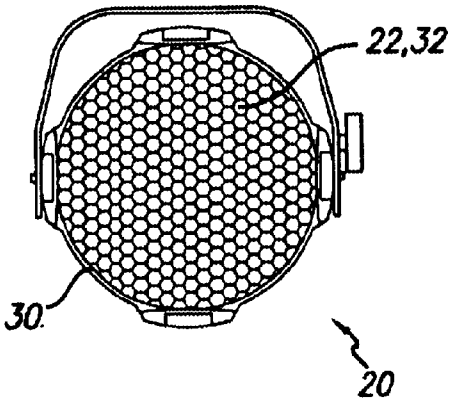
FIG. 3 is a front elevational view of the lighting fixture of FIG. 2, showing the LEDs of the lighting apparatus arranged in a two-dimensional array.
Figure 2:
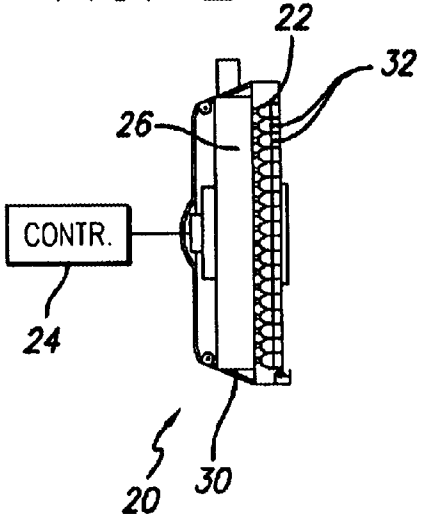
FIG. 2 is a schematic side sectional view of a lighting fixture, which includes a lighting apparatus configured in accordance with a first preferred embodiment of the invention, the lighting apparatus of FIG. 2 including numerous groups of LEDs, each group emitting light having a distinct narrowband spectrum, the groups collectively emitting light spanning a substantial portion of the visible spectrum.

With reference now to the illustrative drawings, and particularly to FIGS. 2–4, there is shown a lighting fixture 20 configured to project a beam of light having a selected color. The fixture includes an array of light-emitting diodes (LEDs) 22 configured to emit light in a range of narrowband colors, e.g., royal blue, blue, cyan, green, two shades of amber, red-orange, and red. A controller 24 supplies selected amounts of electrical power to the LEDs such that they cooperate to emit light having a prescribed composite luminous flux spectrum. The LEDs are mounted on a heat sink 28 within a housing 30. A collimating lens array 32 is located immediately in front of the LED array, and it includes a separate lens component for each LED, for collecting the emitted light to produce a beam that is projected from the fixture, e.g., toward a theater stage (not shown).

The LED lighting fixture 20 of FIGS. 2–4 is equipped with various groups of LEDs 22, each group emitting light having a distinct narrowband color. In one fixture embodiment, the wavelength bands of the LED groups span substantially the entire visible spectrum, i.e., about 420 nanometers (nm) to about 680 nm. Suitable LEDs emitting light in the requisite colors and at high intensities can be obtained from Lumileds Lighting, LLC, of San Jose, Calif. This fixture embodiment can be precisely controlled to emit light having a wide range of colors, including white.

Figure 5:
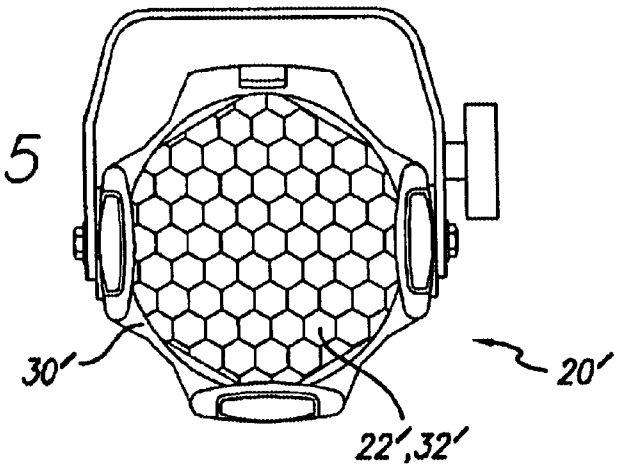
FIG. 5 is a front elevational view of a lighting fixture, which includes a lighting apparatus configured in accordance with a second preferred embodiment of the invention, the lighting apparatus differing from that of FIGS. 2–4 in that its numerous groups of LEDs collectively emit light spanning only a limited portion of the visible spectrum.

In another embodiment of a lighting fixture 20' in accordance with the invention, depicted in FIG. 5, the wavelength bands of the fixture's groups of LEDs 22' span only a limited portion of the visible spectrum, e.g., only wavelengths that are generally blue and green or only wavelengths that are generally amber and red. This fixture embodiment is limited in that it can be controlled only to emit light having certain colors; however, it includes many fewer individual LEDs than does a full-spectrum LED fixture and thus is substantially less expensive to manufacture. A blue/green-only fixture is considered to be particularly commercially viable. This is because blue- and green-colored LEDs are projected to have particularly high efficiencies in the near future and because a blue/green-only fixture can be controlled to emulate roughly one-third of all conventional color filters. Further, incandescent lamps are weakest in the blue/green portion of the visible spectrum.

These various fixture embodiments all are discussed below.

Full-Spectrum LED Lighting Fixture

As mentioned above, one embodiment of an LED lighting fixture 20 in accordance with the invention, depicted in FIGS. 2–4, includes eight groups of LEDs 22, which collectively emit light having a luminous flux spectrum spanning substantially the full visible spectrum, i.e., about 420 nm to about 680 rm. These eight LED groups include royal blue, blue, cyan, green, two shades of amber, red-orange, and red. As will be described below, this fixture embodiment can be controlled to project a beam of light having any of a wide variety of selected colors, including white. Moreover, the fixture can be controlled to produce light having a luminous flux spectrum closely emulating that produced by prior art lighting fixtures, both with and without various color filters. This capability for precise color control, as well as this capability of emulating the colors of prior art fixtures, substantially improves on the performance achieved by previous LED-type lighting fixtures.

Table I identifies one suitable complement of LEDs 22 for the LED lighting fixture 20 incorporating eight different color groups. The basic color of each of the eight groups is specified in the first column, and the Lumileds bin number for group is specified in the second column. The quantity of LEDs in each group is specified in the third column, and the typical peak flux wavelength for each group is specified in the fourth column. Finally, the typical upper and lower limits of the spectral half-width for the LEDs in each group, i.e., the range of wavelengths over which the flux intensity is at least one-half of the peak flux intensity, is specified in the fifth column.

TABLE I

FIXTURE NO. 1 (FULL SPECTRUM)

| LED Color | Lumileds Bin No. | Quantity of Devices | Peak λ (nm) | Spectral Half-Width Range (nm) |
|---|---|---|---|---|
| Royal Blue | B2 | 4 | 450 | 440–460 |
| Blue | B6 | 8 | 472 | 460–484 |
| Cyan | C3 | 18 | 501 | 486–516 |
| Green | G6 | 48 | 540 | 523–557 |
| Amber | A2 | 70 | 590 | 583–597 |
| Amber | A6 | 39 | 595 | 588–602 |
| Red-Orange | R2 | 24 | 627 | 617–637 |
| Red | R5 | 29 | 649 | 639–659 |
| — | — | 241 (Total) | — | — |

It will be noted in Table I that the upper limit of the spectral half-width of each of the eight groups of LEDs 22 generally matches the lower limit of the spectral half-width of the adjacent group. Minimization of any gaps between these upper and lower limits is desirable. This enables the fixture 20 to be controlled to produce light having a composite luminous flux spectrum having a precisely controlled shape. It will be appreciated that a lighting fixture incorporating even more distinct groups of LEDs could provide even greater control over the precise shape of the composite luminous flux spectrum. In such a fixture, the groups of LEDs could be configured such that the upper and lower limits of each group's spectral half-width are generally aligned with the peak wavelengths of the two adjacent groups.

As mentioned above, the full spectrum lighting fixture 20 characterized in Table I can be controlled to produce a composite beam of light having a wide variety of luminous flux spectra. This includes spectra considered to be white, e.g., spectra emulating that of light produced by prior art incandescent lamp fixtures having no color filter, and it also includes spectra having a wide variety of complex colors, e.g., colors emulating that of light produced by prior art fixtures having color filters of conventional design.

It should be noted that the quantities of LEDs specified in the third column of Table I are based on the anticipated efficiencies of LEDs that will be available in the fourth quarter of 2003. Those anticipated efficiencies differ from the efficiencies of LEDs that are available in the first quarter of 2002. A fixture incorporating LEDs of the kind that are available in the first quarter of 2002 would produce only about one-half the total flux of a fixture incorporating LEDs of the kind anticipated to be available in the fourth quarter of 2003. In addition, the relative quantities of the various colors would need to be changed to the following: B2–6, B5–12, C3–28, G6–95, A2–56, A6–24, R2–15, and R5–14. This provides a total LED count of 250, as contrasted with 241 for the complement of LEDs that are anticipated to be available in the fourth quarter of 2003. Of course, if the actual efficiencies for the LEDs available in the fourth quarter of 2003 differ from the anticipated values, appropriate adjustments of the LED quantities will need to be made.

Table II, below, specifies the amount of power that is applied to each of the eight groups of LEDs 22 specified in Table I to produce a composite beam of light emulating that of an incandescent lamp fixture without a color filter and with two different color filters of conventional design. The third column, in particular, specifies that the maximum power, i.e., 100%, is applied to all eight groups when the fixture is desired to emulate an incandescent lamp fixture operating at about 3250° K.

TABLE II

FIXTURE NO. 1 (FULL SPECTRUM)

| LED Color | Lumileds Bin No. | White (% On) | R80 (Primary Blue) (% On) | R26 (Light Red) (% On) |
|---|---|---|---|---|
| Royal Blue | B2 | 100 | 72 | 0 |
| Blue | B6 | 100 | 45 | 1 |
| Cyan | C3 | 100 | 33 | 0 |
| Green | G6 | 100 | 2 | 3 |
| Amber | A2 | 100 | 0 | 35 |
| Amber | A6 | 100 | 1 | 34 |
| Red-Orange | R2 | 100 | 1 | 51 |
| Red | R5 | 100 | 1 | 70 |
| — | — | NMD* = 19.0% | NMD = 13.3% | NMD = 22.9% |

*NMD is Normalized Mean Deviation.

Figure 6:
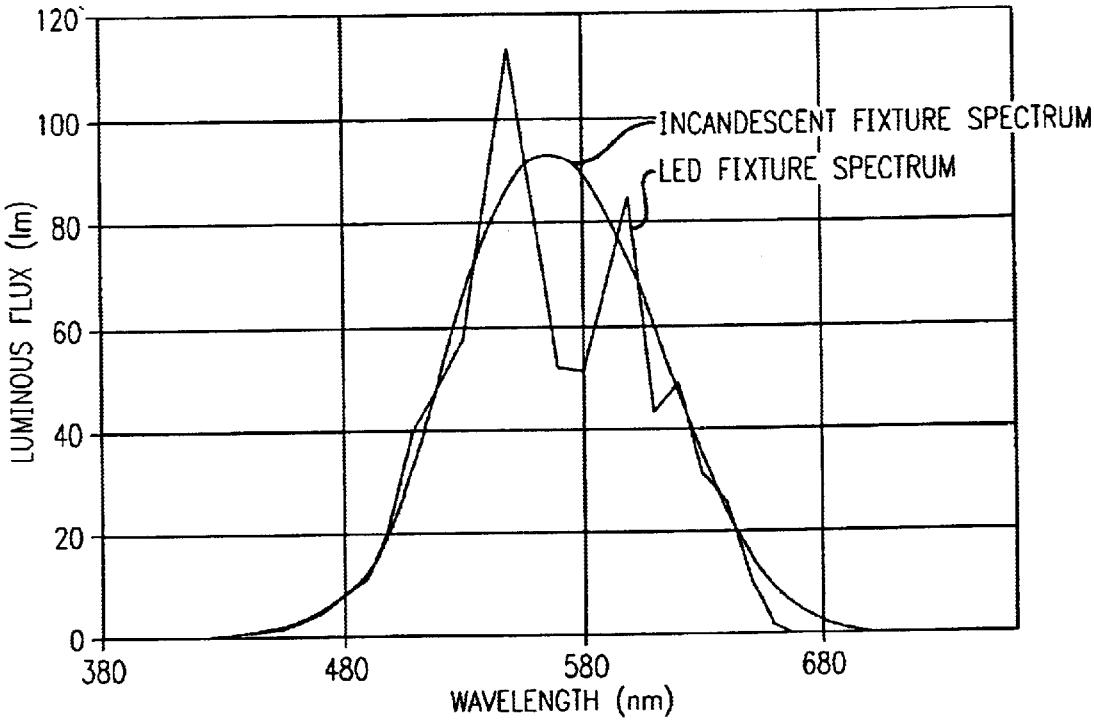
FIG. 6 is a graph depicting the luminous flux spectra for a beam of light produced by the lighting fixture of FIGS. 2–4, having a lighting apparatus incorporating eight groups of LEDs collectively emitting light across substantially the entire visible spectrum, and for a beam of light produced by a prior art lighting fixture having an incandescent lamp operating at 3250° K and no color filter.

FIG. 6 depicts the composite luminous flux spectrum of light produced when full power is applied to all of the eight groups of LEDs 22 in the lighting fixture 20 characterized in Table I. It will be noted that this spectrum spans substantially the entire visible spectrum. Also depicted in FIG. 6 is the luminous flux spectrum of a beam of light projected by a prior art lighting fixture, e.g., a Source Four® fixture, having an incandescent lamp operating at about 3250° K and having no color filter in the beam's path.

Figure 7:
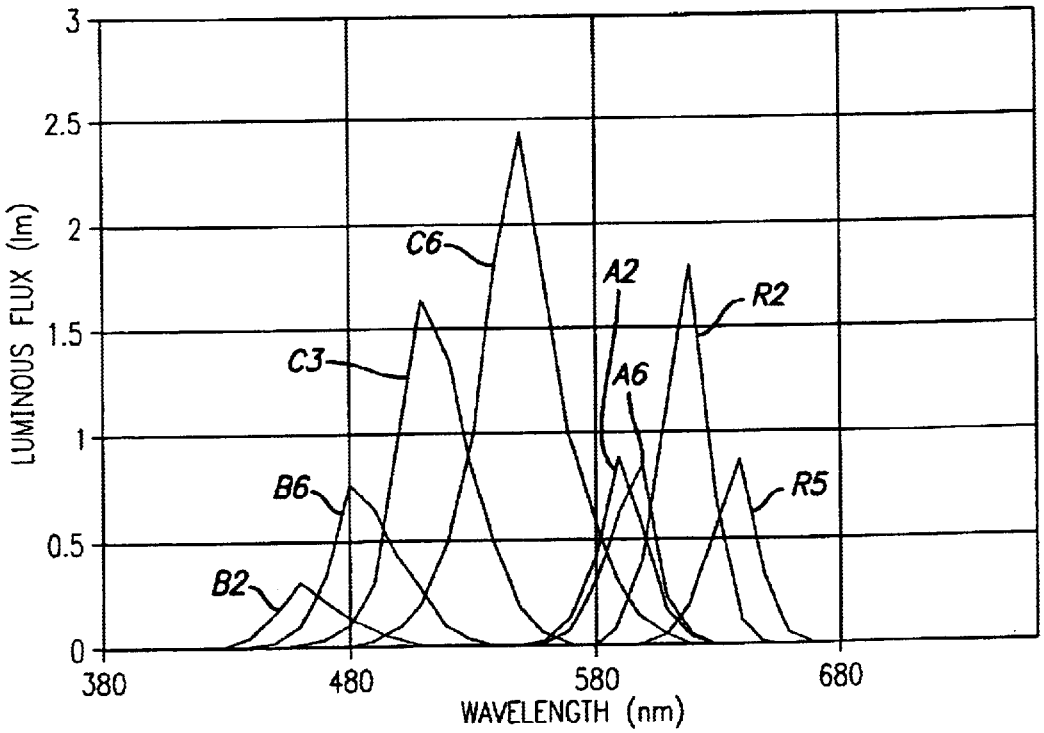
FIG. 7 is a graph depicting the luminous flux spectra for an individual LED in each of the eight groups of LEDs of the lighting apparatus included in the lighting fixture of FIGS. 2–4 and collectively represented by the graph of FIG. 6.

It will be noted in FIG. 6 that the composite spectrum of the LED lighting fixture 20 closely emulates that of the incandescent lamp lighting fixture. This enables the beam of light produced by the LED fixture to have an apparent color of white. In addition, the quantifies of LEDs in each group are selected such that the total flux produced by the fixture is approximately equal to the total flux (in the visible spectrum) produced by the incandescent lamp fixture. Integrating the absolute value of the difference between the two luminous flux spectra depicted in FIG. 6, across the entire visible spectrum, yields a normalized mean deviation (NMD) of just 19.0%. This integration can be performed using the following formula:

$$NMD = \frac{\int [S_T(\lambda) - S_L(\lambda)]d\lambda}{\int S_T(\lambda)d\lambda}$$

where: $\lambda$ is wavelength, $S_L$ is the *LED* fixture spectrum, and $S_T$ is the target fixture spectrum The luminous flux spectra for the individual LEDs 22 making up each of the eight LED groups are depicted in FIG. 7. It will be noted that these spectra overlap each other so that they combine to span a major portion of the visible spectrum. It also will be noted that the peak flux values for some of the individual spectra (e.g., the colors of cyan and green) are significantly higher than they are for other individual spectra (e.g., the two shades of amber). This reflects an inherent disparity in the efficiencies of LEDs that presently are available commercially. It also accounts for why the LED lighting fixture 20 incorporates so many more LEDs in the two amber shades (109 combined) as compared to the cyan color (18). Of course, if the efficiency disparity between the various commercially available LEDs changes in the future, appropriate changes can be made to the quantities of each LED required for the fixture to provide the desired spectrum.

Figure 1:
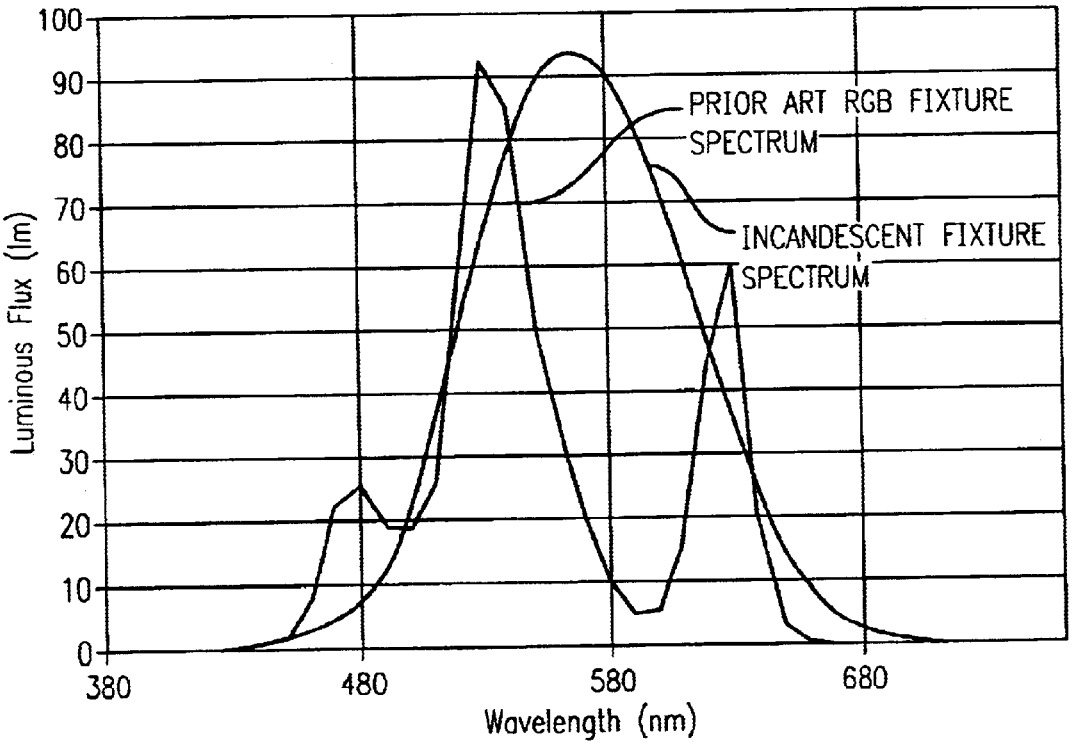
FIG. 1 PRIOR ART
FIG. 1 is a graph depicting the luminous flux spectra for beams of light produced by a prior art lighting fixture having an incandescent lamp operating at about 3250° K and no color filter, and by a prior art lighting fixture having equal quantities of red-, green-, and blue-colored light-emitting diodes (LEDs).

The LED lighting fixture 20 of FIGS. 2–4 thereby provides a good emulation of an incandescent lamp lighting fixture, operating at full power, and it thus provides good color rendition. The fixture improves significantly over the NMD achieved by the prior art RGB LED fixture, described above with reference to FIG. 1.

It is important to note that the NMD of the LED lighting fixture 20 is improved significantly not only by increasing the number of distinct groups of LEDs 22, but also by tailoring the specific quantity of LEDs in each such group. In the case of the LED lighting fixture characterized in Table I, it will be noted that the quantities of LEDs range from a low of 4 for the royal blue color to a high of 70 for one of the two shades of amber. A lighting fixture incorporating equal quantities of LEDs provides a substantially higher NMD.

As mentioned above, the LED lighting fixture 20 characterized in Table I also can be controlled to produce light having a variety of complex colors other than white. These colors include, but are not limited to, colors having luminous flux spectra closely emulating that of light produced by conventional incandescent lamp fixtures equipped with various conventional color filters. This is an important advantage in making the fixture immediately acceptable in the industry as a suitable replacement for existing incandescent lamp fixtures.

Conventional incandescent lamp lighting fixtures produce beams of colored light by filtering the lamp's "white" light using color filters. These filters have certain spectral transmission characteristics such that desired wavelengths are transmitted while the remaining wavelengths are absorbed. The LED lighting fixture 20 can be controlled to produce a beam of light having a color spectrum emulating that of a beam of light produced by an incandescent lamp fixture equipped with a particular color filter by appropriately controlling the various groups of LEDs 22 to emit light having the desired overall color spectrum. Thus, electrical power is supplied to each of the eight LED groups such that the group emits the amount of light of the corresponding color that would be transmitted by the color filter in question.

As is conventional, the controller 24 can effect this proportionate power control by appropriately varying the duty cycles of pulse-width modulated power it supplies to the eight LED groups. Reducing the duty cycle for power supplied to any one particular LED group correspondingly reduces the magnitude of flux emitted by such group, changing the composite flux spectrum accordingly.

Figure 8:
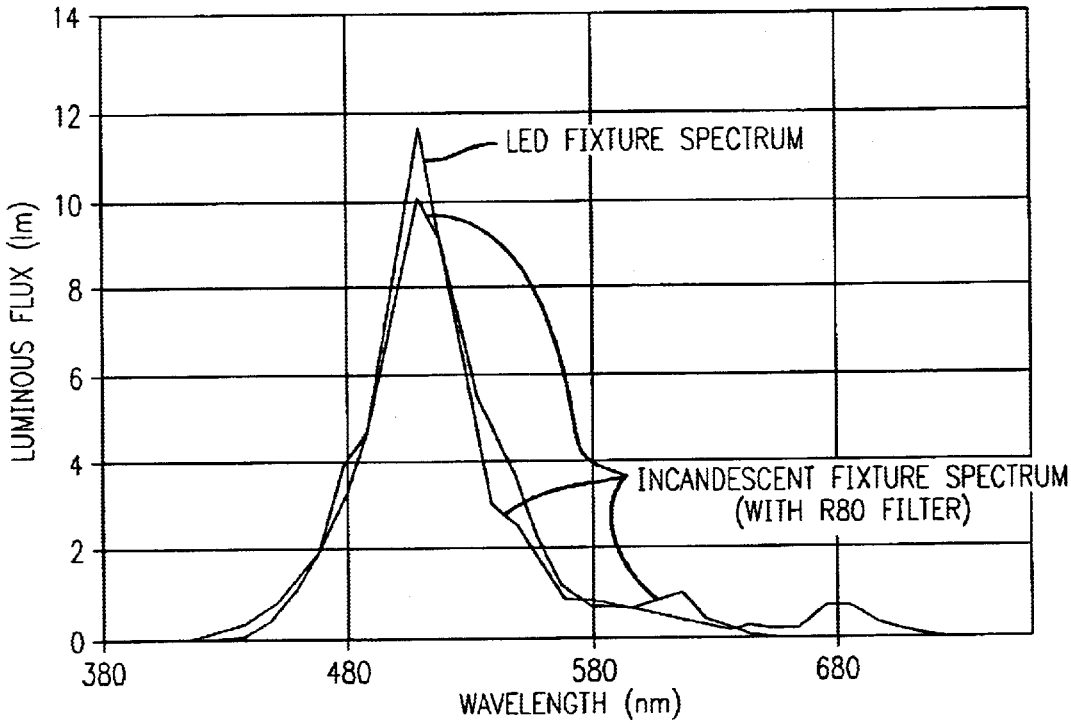
FIG. 8 is a graph depicting the luminous flux spectra for a beam of light produced by the lighting fixture of FIGS. 2–4, whose eight groups of LEDs are delivered controlled amounts of electrical current such that the fixture produces a beam of light having a blue color, and for a beam of light produced by a prior art lighting fixture having an incandescent lamp operating at 3250° K and a conventional Rosco R80 blue filter.

In one example, the LED lighting fixture 20 is controlled to project a light beam having a flux spectrum that emulates that of an incandescent lamp lighting fixture incorporating a primary blue filter having the standard commercial designation Rosco R80. Such filters can be obtained from Rosco Laboratories Inc., of Hollywood, Calif. The spectrum of the beam of light to be emulated is depicted in FIG. 8. The LED fixture can be controlled to emulate this primary blue spectrum by controlling the various colored LEDs in the proportions identified in the fourth column of Table II, above. Specifically, the group of 4 royal blue LEDs is powered at 72% of full power, the group of 8 blue LEDs is powered at 45% of full power, etc. The resulting flux spectrum is depicted in FIG. 8.

It will be noted in FIG. 8 that the composite spectrum of the light produced by the LED lighting fixture 20 closely emulates that of the incandescent lamp lighting fixture incorporating an R80 filter. This enables the beam of light produced by the LED fixture to have an apparent color that closely matches that of the incandescent lamp fixture. Integrating the absolute value of the difference between the two luminous flux spectra depicted in FIG. 8, across the entire visible spectrum, yields a normalized mean deviation (NMD) of just 13.3%.

It will be noted that, in controllably powering the LED lighting fixture 20 so as to emulate an incandescent lamp lighting fixture incorporating a Rosco R80 blue filter, the LED fixture can produce the same level of total flux as does the incandescent lamp fixture even though substantially less than full power is supplied to all of the eight groups of LEDs. In fact, the most power that needs to be supplied to any one group of LEDs is 72% of the maximum power, which is applied to the royal blue LEDs. It therefore will be appreciated that the LED fixture actually can produce a beam of light having significantly more total flux than can the incandescent lamp fixture, i.e., 1/0.72, or 1.39 times as much flux.

Figure 9:
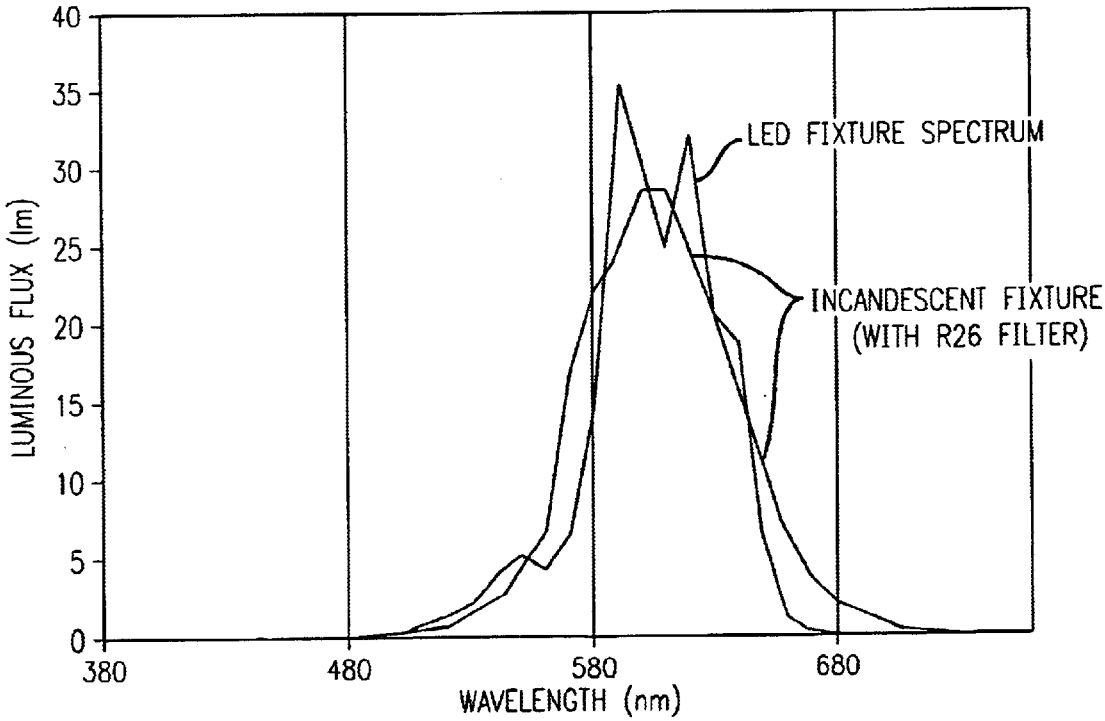
FIG. 9 is a graph depicting the luminous flux spectra for a beam of light produced by the lighting fixture of FIGS. 2–4, whose eight groups of LEDs are delivered controlled amounts of electrical current, such that the fixture produces a beam of light having a red color, and for a beam of light produced by a prior art lighting fixture having an incandescent lamp operating at 3250° K and a conventional Rosco R26 red filter.

Other colors produced by a conventional incandescent lamp fixture can be emulated in a similar fashion. One example is a light beam having a flux spectrum that emulates that of an incandescent lamp fixture incorporating a light red filter having the standard commercial designation Rosco R26. The spectrum of the beam of red light to be emulated is depicted in FIG. 9. The LED fixture 20 can be controlled to emulate this light red spectrum by controlling the various colored LEDs 22 in the proportions identified in the fifth column of Table II, above. Specifically, the group of 29 red LEDs are powered at 70% of full power, the group of 24 red-orange LEDs are powered at 51% of full power, etc. The resulting luminous flux spectrum, likewise, is depicted in FIG. 9. It exhibits a low NMD of just 22.9%. In addition, the beam of light produced by the LED fixture can have a total flux that is 1/0.70, or 1.43, higher than that produced by the incandescent lamp fixture.

The lighting fixture 20 also, of course, can be controlled to emit light having any of billions of distinct luminous flux spectra, not just those emulating the spectra of other light sources. This is achieved simply by independently controlling the duty cycles of power supplied to each of the groups of light-emitting devices 22.

Blue/Green-Only LED Lighting Fixture

As mentioned above, a second embodiment of an LED lighting fixture 20' (FIG. 5) in accordance with the invention includes just four groups of LEDs 22', collectively emitting light having a luminous flux spectrum spanning just a portion of the visible spectrum, i.e., from about 420 nn to about 580 nm. These four LED groups include royal blue, blue, cyan, and green. This blue/green LED lighting fixture can be controlled to project a beam of light having a variety of complex blue and green colors, including but not limited to colors having luminous flux spectra closely emulating that of light produced by known prior art lighting fixtures equipped with any of a large number of conventional blue-, green-, and cyan-colored filters. As mentioned above, such filters represent about one-third of all conventional color filters.

Table III identifies one suitable complement of LEDs 22' for the blue/green-only LED lighting fixture 20', which incorporates just four different groups of LED colors, including royal blue, blue, cyan, and green. The basic color of each of the four groups is specified in the first column, the Lumileds bin number is specified in the second column, and the quantity of LEDs in each group is specified in the third column.

TABLE III

FIXTURE NO. 2 (BLUE/GREEN ONLY)

| LED Color | Lumileds Bin No. | Quantity of Devices | R80 Primary Blue (% On) |
|---|---|---|---|
| Royal Blue | B2 | 5 | 73 |
| Blue | B5 | 5 | 62 |
| Cyan | C3 | 15 | 40 |
| Green | G6 | 29 | 3 |
| — | | 54 - Total | NMD = 16.7% |

Figure 10:
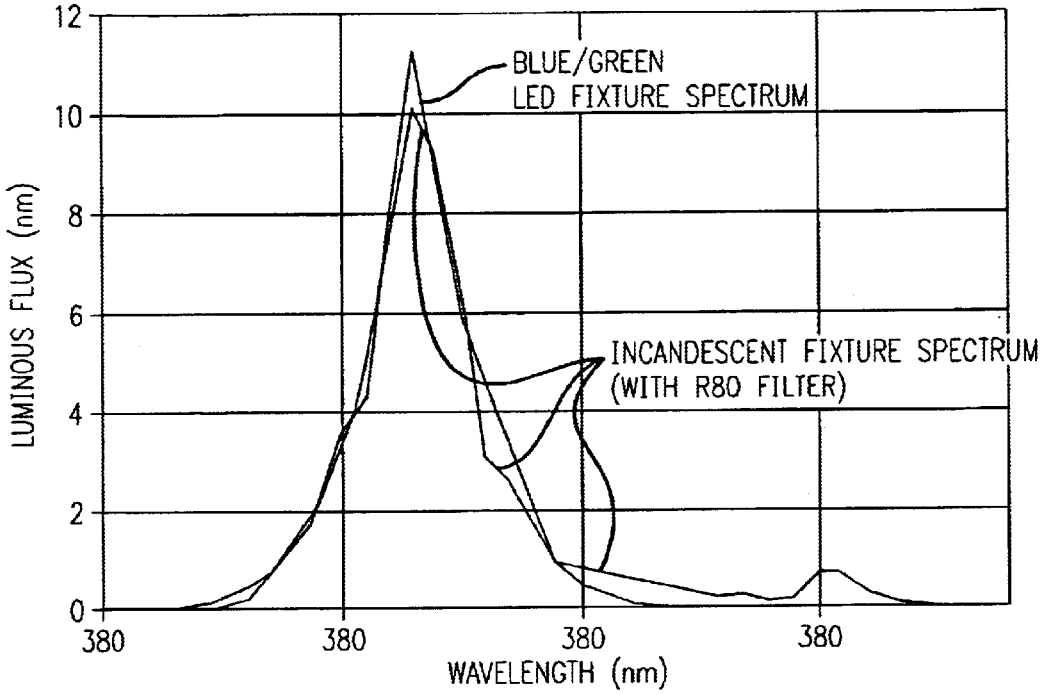
FIG. 10 is a graph depicting the luminous flux spectra for a beam of light produced by the lighting fixture of FIG. 5, whose four groups of LEDs are delivered controlled amounts of electrical current, such that the fixture produces a beam of light having a blue color, and for a beam of light produced by a prior art lighting fixture having an incandescent lamp operating at 3250° K and a conventional Rosco R80 blue filter.

Thus the blue/green-only LED lighting fixture 20' characterized in Table III includes just 54 individual LEDs 22', arranged in four distinct groups. Nevertheless, by powering the four groups of LEDs at the power levels specified in the fourth column of Table III, the blue/green-only fixture can be controlled to emulate the an incandescent lamp fixture incorporating a Rosco R80 primary blue filter. The resulting luminous flux spectrum and the luminous flux of an incandescent lamp fixture incorporating an R80 filter are depicted in FIG. 10. The two spectra conform to each other with a NMD of just 16.7%.

Although the blue/green-only LED lighting fixture 20' is limited in that it can be controlled to emit light incorporating only blue and green wavelengths, it will be appreciated that the fixture includes less than one quarter the quantity of individual LEDs incorporated into the full-spectrum LED fixture 20 (FIGS. 2–4) characterized in Table I. Consequently, the blue/green-only fixture is substantially less expensive to manufacture. Despite this difference in LED quantities, the blue/green fixture can produce light having nearly the same total flux as can the full-spectrum fixture, when that latter fixture is being controlled to emit blue or green light.

It should be noted that the quantities of LEDs specified in the third column of Table III are based on the anticipated efficiencies of LEDs that will be available in the fourth quarter of 2003. A fixture incorporating LEDs of the kind that are available in the first quarter of 2002 would produce only about one-quarter the total flux of a fixture incorporating LEDs of the kind anticipated to be available in the fourth quarter of 2003. The relative quantities of the various colors would need to be changed to the following: B2–4, B5–5, C3–11, and G6–34. This provides a total LED count of 54, the same as that for the complement of LEDs that are anticipated to be available in the fourth quarter of 2003. Of course, if the actual efficiencies for the LEDs available in the fourth quarter of 2003 differ from the anticipated values, appropriate adjustments of the LED quantities will need to be made.

Figure 11:
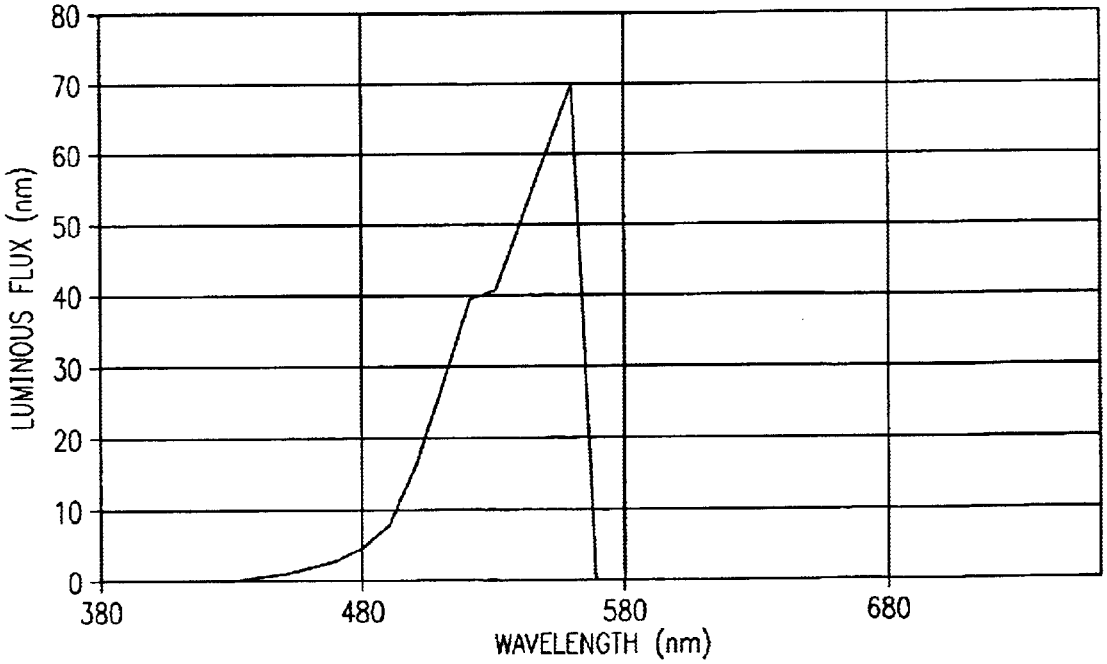
FIG. 11 is a graph depicting a superposition of the luminous flux spectra of an incandescent lamp lighting fixture and about 50 different conventional blue and green filters.

Preferably, the quantities of LEDs 22' in each of the four identified LED groups are selected so that applying maximum power the all of the LEDs will produce a luminous flux spectrum emulating that represented by a theoretical superposition of a large number of conventional blue and green filters. The Rosco R80 filter is just one of these conventional filters. In this way, the fixture 20' can be controlled to emulate any one of the filters simply by adjusting the duty cycle of the pulse-width modulated power applied to each LED group. The superposition spectrum mentioned above is depicted in FIG. 11.

Other LED Lighting Fixtures

Other embodiments of LED lighting fixtures in accordance with the invention, likewise, can include groups of LEDs spanning less than the full visible spectrum. For example, one such embodiment could include just four groups of LEDs, i.e., two shades of amber, red-orange, and red. That embodiment would function as a red/amber-only fixture, being controllable to emulate the luminous flux spectrum of any one of a large number of conventional amber and red filters.

Yet another embodiment of an LED lighting fixture in accordance with the invention is configured to emulate any selected color filter, of conventional design. Such fixture includes groups of LEDs spanning the full spectrum, but in quantities selected so that, at full power, the LEDs cooperate to produce a beam of light having a luminous flux spectrum corresponding to that of a superposition of all known conventional color filters. The fixture can be controlled to emulate any one of the filters simply by adjusting the duty cycle of the pulse-width modulated power applied to each LED group. White light having a luminous flux spectrum emulating that of a incandescent lamp fixture also could be produced (but with lower total flux than the full spectrum fixture characterized in Table I, above), by a similar duty cycle adjustment.

It should be appreciated from the foregoing description that the present invention provides an improved lighting apparatus of a kind that is suitable for use as part of a lighting fixture and that can be controlled to produce a beam of light having a wide variety of complex luminous flux spectra, including, but not limited, to spectra that closely emulate that of any one of a number of conventional light sources, with or without a color filter. The lighting apparatus includes a plurality of groups of light-emitting devices, e.g., LEDs, and each such group is configured to emit light having a distinct luminous flux spectrum. A controller supplies selected amounts of electrical power to two or more groups of the plurality of groups of light-emitting devices, such that the groups cooperate to project a composite beam of light having a selected luminous flux spectrum. The spectrum can be controlled to have a normalized mean deviation across the visible spectrum relative to that of a beam of light to be emulated, of less than about 30%. This is a marked improvement over all known lighting fixtures of the kind including multiple groups of distinct light sources. The groups of light-emitting devices are configured to include independently selected quantities of devices. Further, the groups of light-emitting devices are configured to each have a spectral half-width of less than about 40 nm, and to have peak flux wavelengths that are spaced less than about 50 mm from that of an adjacent group.

Although the invention has been described in detail with reference only to the preferred embodiments, those skilled in the art will appreciate that various modifications can be made without departing from invention. Accordingly, the invention is defined only by the following claims.

I claim:

1. A lighting apparatus for producing a beam of light having a luminous flux spectrum emulating that of a beam of light produced by a predetermined light source having an incandescent lamp, such light source being free of a filter that modifies the luminous flux spectrum of the light emitted by the lamp, the apparatus being suitable for use as part of a lighting fixture and comprising:

a plurality of groups of light-emitting devices, each such group configured to emit light having a distinct luminous flux spectrum; and a controller configurable to supply selected amounts of electrical power to the plurality of groups of light-emitting devices, such that the groups cooperate to produce a composite beam of light having a prescribed luminous flux spectrum that has a normalized mean deviation across the visible spectrum of less than about 30% relative to the luminous flux spectrum of a beam of light produced by the predetermined light source to be emulated.

2. A lighting apparatus as defined in claim 1, wherein the quantities of devices included in each of the plurality of groups of light-emitting devices are selected such that, if the controller supplies maximum electrical power to all of the groups, then the resulting composite beam of light will have a luminous flux spectrum having a normalized mean deviation across the visible spectrum of less than about 30% relative to the luminous flux spectrum of a beam of light produced by the predetermined light source to be emulated.

3. A lighting apparatus as defined in claim 1, wherein the quantities of devices included in each of the plurality of groups of light-emitting devices are selected such that, if the controller supplies maximum electrical power to all of the groups, then the resulting composite beam of light will have a luminous flux spectrum having a normalized mean deviation across the visible spectrum of less than about 30% relative to the luminous flux spectrum of a theoretical beam of light produced by a predetermined light source having an incandescent lamp, as modified by a theoretical superposition of the spectral transmissions of a plurality of color filters.

4. A lighting apparatus as defined in claim 1, wherein the controller further is configurable to supply selected amounts of electrical power to the plurality of groups of light-emitting devices, such that the groups cooperate to produce a composite beam of light having a prescribed luminous flux spectrum that has a normalized mean deviation across the visible spectrum of less than about 30% relative to the luminous flux spectrum of a beam of light produced by a predetermined light source that includes an incandescent lamp and a filter that modifies the luminous flux spectrum of the light emitted by such lamp.

5. A lighting apparatus as defined in claim 1, wherein at least two of the plurality of groups of light-emitting devices include different quantities of light-emitting devices.

6. A lighting apparatus as defined in claim 1, wherein the plurality of groups of light-emitting devices include at least five groups of light-emitting devices, each such group being configured to emit light having a predetermined distinct luminous flux spectrum.

7. A lighting apparatus as defined in claim 1, wherein the plurality of groups of light-emitting devices include at least eight groups of light-emitting devices, each such group being configured to emit light having a predetermined distinct luminous flux spectrum.

8. A lighting apparatus as defined in claim 1, wherein each of the plurality of groups of light-emitting devices includes a plurality of light-emitting diodes.

9. A lighting apparatus as defined in claim 1, wherein the plurality of groups of light-emitting devices together comprise an optical assembly that collects the emitted light and projects the composite beam of light from the apparatus.

10. A lighting apparatus as defined in claim 1, wherein the luminous flux spectrum of the composite beam of light has a normalized mean deviation across the visible spectrum of less than about 25% relative to the luminous flux spectrum of a beam of light produced by the predetermined light source to be emulated.

11. A lighting apparatus as defined in claim 1, wherein the luminous flux spectrum of the composite beam of light has a normalized mean deviation across the visible spectrum of less than about 20% relative to the luminous flux spectrum of a beam of light produced by the predetermined light source to be emulated.

12. A lighting apparatus as defined in claim 1, wherein the luminous flux spectra of the beam of light produced by the lighting apparatus and of the beam of light produced by the predetermined light source to be emulated are within 5 db of each other across the visible spectrum when the controller supplies prescribed maximum amounts of electrical power to all of the groups of light-emitting devices.

13. A lighting apparatus as defined in claim 1, wherein the predetermined distinct luminous flux spectrum of the light emitted by each of the plurality of groups of light-emitting devices has a spectral half-width of less than about 40 nanometers.

14. A lighting apparatus as defined in claim 1, wherein:

the distinct luminous flux spectrum of the light emitted by each of the plurality of groups of light-emitting devices has a predetermined peak flux wavelength and a predetermined spectral half-width;

the peak flux wavelength of each of the plurality of groups of light-emitting devices is spaced less than about 50 nanometers from the peak flux wavelength of another of the plurality of groups of light-emitting devices; and the spectral half-width of each of the plurality of groups of light-emitting devices is less than about 40 nanometers.

15. A lighting apparatus for producing a beam of colored light having a prescribed luminous flux spectrum, the apparatus being suitable for use as part of a lighting fixture and comprising:

a plurality of groups of light-emitting devices, each such group configured to emit light having a distinct luminous flux spectrum; and a controller configurable to supply selected amounts of electrical power to the plurality of groups of light-emitting devices, such that the groups cooperate to produce a composite beam of light;

wherein the composite beam of light has a prescribed luminous flux spectrum having substantial energy only within a contiguous bandwidth of less than about 200 nanometers when the controller supplies prescribed maximum amounts of electrical power to all of the groups of light-emitting devices.

16. A lighting apparatus as defined in claim 15, wherein:

each group of light-emitting devices is free of a filter that substantially changes the luminous flux spectrum of its emitted light; and the controller is configurable to supply selected amounts of electrical power to the plurality of groups of light-emitting devices, such that the composite beam of light has a prescribed luminous flux spectrum emulating that of a predetermined light source having an incandescent lamp, such light source further having an associated filter that modifies the luminous flux spectrum of the light emitted by the lamp.

17. A lighting apparatus as defined in claim 16, wherein the luminous flux spectrum of the composite beam of light has a normalized mean deviation across the visible spectrum of less than about 30% relative to the luminous flux spectrum of a beam of light produced by the predetermined light source to be emulated.

18. A lighting apparatus as defined in claim 16, wherein the quantities of devices included in each of the plurality of groups of light-emitting devices are selected such that, if the controller supplies maximum electrical power to all of the groups, then the resulting composite beam of light will have a luminous flux spectrum having a normalized mean deviation across the visible spectrum of less tan about 30% relative to the luminous flux spectrum of a theoretical beam of light produced by the predetermined light source, as modified by a theoretical superposition of the spectral transmissions of a plurality of color filters.

19. A lighting apparatus as defined in claim 15, wherein the composite beam of light produced by the plurality of groups of light-emitting devices has a luminous flux spectrum having substantial energy only in wavelengths of less than about 600 nanometers when the controller supplies prescribed maximum amounts of electrical power to all of the groups of light-emitting devices.

20. A lighting apparatus as defined in claim 15, wherein the composite beam of light produced by the plurality of groups of light-emitting devices has a luminous flux spectrum having substantial energy only in wavelengths of more than about 550 nanometers when the controller supplies prescribed maximum amounts of electrical power to all of the groups of light-emitting devices.

21. A lighting apparatus as defined in claim 15, wherein at least two of the plurality of groups of light-emitting devices include different quantities of light-emitting devices.

22. A lighting apparatus as defined in claim 15, wherein the plurality of groups of light-emitting devices include at least four groups of light-emitting devices, each such group being configured to emit light having a predetermined distinct luminous flux spectrum.

23. A lighting apparatus as defined in claim 15, wherein each of the plurality of groups of light-emitting devices includes a plurality of light-emitting diodes.

24. A lighting apparatus as defined in claim 15, wherein:

the distinct luminous flux spectrum of the light emitted by each of the plurality of groups of light-emitting devices has a predetermined peak flux wavelength and a predetermined spectral half-width;

the peak flux wavelength of each of the plurality of groups of light-emitting devices is spaced less than about 50 nanometers from the peak flux wavelength of another of the plurality of groups of light-emitting devices; and the spectral half-width of each of the plurality of groups of light-emitting devices is less than about 40 nanometers.

25. A lighting apparatus as defined in claim 15, wherein the composite beam of light has a luminous flux spectrum having substantial energy only within a contiguous bandwidth of less than about 150 nanometers.

26. A lighting apparatus as defined in claim 15, wherein no portion of the contiguous flux spectrum of the composite beam of light has a flux intensity more than 5 db lower than flux intensities at wavelengths both above and below it.

27. A lighting apparatus as defined in claim 15, wherein no portion of the contiguous flux spectrum of the composite beam of light has a flux intensity more than 2 db lower than flux intensities at wavelengths both above and below it.

28. A lighting apparatus for producing a beam of light having a prescribed luminous flux spectrum, the lighting apparatus being suitable for use as part of a lighting fixture and comprising:

a plurality of groups of light-emitting devices, each such group configured to emit light having a distinct luminous flux spectrum, and at least two of the plurality of groups including substantially different quantities of devices from each other; and a controller configurable to supply selected amounts of electrical power to the plurality of groups of light-emitting devices, such that the groups cooperate to produce a composite beam of light having a prescribed luminous flux spectrum.

29. A lighting apparatus as defined in claim 28, wherein:

each of the plurality of groups of light-emitting devices is free of a filter that substantially changes the luminous flux spectrum of its emitted light;

the prescribed luminous flux spectrum is made to emulate that of a beam of light produced by a predetermined light source having an incandescent lamp, such light source being free of a filter that modifies the luminous flux spectrum of the light emitted by the lamp; and the controller is configurable to supply selected amounts of electrical power to the plurality of groups of light-emitting devices, such that the composite beam of light has a prescribed luminous flux spectrum that has a normalized mean deviation across the visible spectrum of less than about 30% relative to the luminous flux spectrum of a beam of light produced by the predetermined light source to be emulated.

30. A lighting apparatus as defined in claim 29, wherein the quantities of devices included in each of the plurality of groups of light-emitting devices are selected such that, if the controller supplies maximum electrical power to all of the groups, then the resulting composite beam of light will have a luminous flux spectrum having a normalized mean deviation across the visible spectrum of less than about 30% relative to the luminous flux spectrum of a beam of light produced by the predetermined light source to be emulated.

31. A lighting apparatus as defined in claim 29, wherein the luminous flux spectra of the beam of light produced by the lighting apparatus and of the beam of light produced by the light source to be emulated are within 5 db of each other across the visible spectrum when the controller supplies prescribed maximum amounts of electrical power to all of the groups of light-emitting devices.

32. A lighting apparatus as defined in claim 28, wherein:

each group of light-emitting devices is free of a filter that substantially changes the luminous flux spectrum of its emitted light;

the prescribed luminous flux spectrum is made to emulate that of a beam of light produced by a predetermined light source having an incandescent lamp, such light source further having an associated filter that modifies the luminous flux spectrum of the light emitted by the lamp; and the controller is configurable to supply selected amounts of electrical power to at least two of the plurality of groups of light-emitting devices, such that the composite beam of light has a prescribed luminous flux spectrum that has a normalized mean deviation across the visible spectrum of less than about 30% relative to the luminous flux spectrum of a beam of light produced by the predetermined light source to be emulated.

33. A lighting apparatus as defined in claim 28, wherein the plurality of groups of light-emitting devices include at least four groups of light-emitting devices, each such group being configured to emit light having a predetermined distinct luminous flux spectrum.

34. A lighting apparatus as defined in claim 28, wherein each of the plurality of groups of light-emitting devices includes a plurality of light-emitting diodes.

35. A lighting apparatus as defined in claim 28, wherein:

the distinct luminous flux spectrum of the light emitted by each of the plurality of groups of light-emitting devices has a predetermined peak flux wavelength and a predetermined spectral half-width;

the peak flux wavelength of each of the plurality of groups of light-emitting devices is spaced less than about 50 nanometers from the peak flux wavelength of another of the plurality of groups of light-emitting devices; and the spectral half-width of each of the plurality of groups of light-emitting devices is less than about 40 nanometers.

36. A lighting apparatus for producing a beam of light having a prescribed luminous flux spectrum, the lighting apparatus being suitable for use as part of a lighting fixture and comprising:

five or more groups of light-emitting devices, wherein each such group is configured to emit light having a distinct luminous flux spectrum; and a controller configurable to supply selected amounts of electrical power to the five or more groups of light-emitting devices, such that the groups cooperate to produce a composite beam of light having a prescribed luminous flux spectrum.

37. A lighting apparatus as defined in claim 36, wherein the five or more groups of light-emitting devices include eight or more groups of light-emitting devices, each such group being configured to emit light having a predetermined distinct luminous flux spectrum.

38. A lighting apparatus as defined in claim 36, wherein each of the five or more groups of light-emitting devices includes a plurality of light-emitting diodes.

39. A lighting apparatus as defined in claim 36, wherein:

the distinct luminous flux spectrum of the light emitted by each of the five or more groups of light-emitting devices has a predetermined peak flux wavelength and a predetermined spectral half-width;

the peak flux wavelength of each of the five or more groups of light-emitting devices is spaced less than about 50 nanometers from the peak flux wavelength of another of the plurality of groups of light-emitting devices; and the spectral half-width of each of the plurality of groups of light-emitting devices is less than about 40 nanometers.

40. A lighting apparatus as defined in claim 36, wherein the five or more groups of light-emitting devices cooperate to emit light spanning substantially the entire visible spectrum.

41. A lighting apparatus for producing a beam of light having a prescribed luminous flux spectrum, the lighting apparatus being suitable for use as part of a lighting fixture and comprising:

three or more groups of light-emitting devices, each such group configured to emit light having a distinct luminous flux spectrum with a predetermined peak flux wavelength and a predetermined spectral half-width;

wherein the peak flux wavelength of each of the three or more groups of light-emitting devices is spaced less than about 50 nanometers from the peak flux wavelength of another of the groups of light-emitting devices;

and wherein the spectral half-width of each of the three or more groups of light-emitting devices is less than about 40 nanometers; and a controller configurable to supply selected amounts of electrical power to the three or more groups of light-emitting devices, such that the groups cooperate to produce a composite beam of light having a prescribed luminous flux spectrum.

42. A lighting apparatus as defined in claim 41, wherein the three or more groups of light-emitting devices include eight or more groups of light-emitting devices, each such group configured to emit light having a distinct luminous flux spectrum with a predetermined peak flux wavelength and a predetermined spectral half-width.

43. A lighting apparatus as defined in claim 41, wherein:

each of the plurality of groups of light-emitting devices is free of a filter that substantially changes the luminous flux spectrum of its emitted light;

the prescribed luminous flux spectrum is made to emulate that of a beam of light produced by a predetermined light source having an incandescent lamp, such light source being free of a filter that modifies the luminous flux spectrum of the light emitted by the lamp; and the controller is configurable to supply selected amounts of electrical power to the plurality of groups of light-emitting devices, such that the composite beam of light has a prescribed luminous flux spectrum that has a normalized mean deviation across the visible spectrum of less than about 30% relative to the luminous flux spectrum of a beam of light produced by the predetermined light source to be emulated.

* * * * *

UNITED STATES PATENT AND TRADEMARK OFFICE

CERTIFICATE OF CORRECTION

PATENT NO. : 6,683,423 B2
DATED : January 27, 2003
INVENTOR(S) : David W. Cunningham It is certified that error appears in the above-identified patent and that said Letters Patent is hereby corrected as shown below:

Title page,
Item [56], References Cited, please add the following:
-- U.S. PATENT DOCUMENTS
US 2003/0133292 A1 07/17/03 Mueller et al. 362/231 --

Column 2,
Line 12, “lid” should be -- light --.
Line 61, “(nn)” should be -- nm --.
Line 62, “run” should be -- nm --.

Column 5,
Line 23, “um” should be -- nm --.
Line 55, “light-emits” should be -- light-emitting --.

Column 7,
Line 51, “rm” should be -- nm --.

Column 9,
Line 39, “quantifies” should be -- quantities --.

Column 11,
Line 24, “1/0.72” should be -- 1/.72 --.
Line 41, “1/0.70” should be -- 1/.70 --.
Line 55, “nn” should be -- nm --.

Column 12,
Line 24, after “emulate”, please delete “the”.

Column 13,
Line 54, “mm” should be -- nm --.

UNITED STATES PATENT AND TRADEMARK OFFICE

CERTIFICATE OF CORRECTION

PATENT NO. : 6,683,423 B2
DATED : January 27, 2003
INVENTOR(S) : David W. Cunningham It is certified that error appears in the above-identified patent and that said Letters Patent is hereby corrected as shown below:

Column 16,
Line 9, “tan” should be -- than --.

Signed and Sealed this

Fourth Day of May, 2004

JON W. DUDAS
*Acting Director of the United States Patent and Trademark Office*